United States Patent [19]

Hendrickson

[11] 4,138,110

[45] Feb. 6, 1979

[54] KICKER APPARATUS FOR TABLE GAME

[76] Inventor: Richard L. Hendrickson, 1821 N. 11th St., Bismarck, N. Dak. 58501

[21] Appl. No.: 839,432

[22] Filed: Oct. 5, 1977

[51] Int. Cl.[2] ..... A63F 7/08; A63F 7/10

[52] U.S. Cl. ..... 273/85 D; 46/22

[58] Field of Search ..... 273/85 D, 85 C; 46/22

[56] References Cited

U.S. PATENT DOCUMENTS

| | | | |
|---|---|---|---|
| D. 217,372 | 4/1970 | Patterson | 273/85 C |
| 3,926,432 | 12/1975 | Furr et al. | 273/85 D |
| 4,042,239 | 8/1977 | Cecchetti | 273/85 D X |
| 4,076,244 | 2/1978 | Peppard | 273/85 D |

FOREIGN PATENT DOCUMENTS

| | | | |
|---|---|---|---|
| 980203 | 12/1950 | France | 273/85 D |

*Primary Examiner*—George J. Marlo

[57] ABSTRACT

Kicker apparatus for a table game that includes a head portion that has a lower part that has leg portions that at least in part define an arcuate surface portion that forms a mating fit with an actuating rod, the actuating rod being rotatably slidably mounted on the game table, and a lower kicker portion having arcuately curved legs to extend partially around the lower part in close fitting relationship thereto. The upper terminal ends of the legs are of a minimum spacing that is greater than the diameter of the rod so that the kicker portion can be replaced without removing the rod from the table. A bolt is provided to hold the head and kicker portions together in a fixed position relative the rod. In one embodiment the leg portions are a part of a ring portion through which the rod extends while in the other embodiment the leg portions have lower terminal ends and the kicker portion has a surface that abuts against the rod.

15 Claims, 4 Drawing Figures

KICKER APPARATUS FOR TABLE GAME

BACKGROUND OF THE INVENTION

A kicker member for a table game.

With table games such as Football or table soccer a number of kicker members are provided on each actuating rod, for example see U.S. Pat. No. 3,926,432. One of the maintenance problems with such a game is that frequently the kicker member breaks just below the actuating rod. When this happens it is necessary to remove the rod from the game table including removing the kicker members in order to replace the broken kicker member. This is time consuming. In FIG. 5 of Swiss Pat. No. 176,073 (Dec. 2, 1935) there is shown a kicker figure having a recessed portion through which the acutating rod is extended and a clamp bracket secured to the figure by screws to removably mount the figure on the rod. However, for the most part, the figure is located horizontally to one side of the rod; and if broken, would require replacing the entire kicker figure. In Swiss Pat. No. 313,587 there is disclosed a game table accessory that appears to be made of two identical half portions (one inverted relative the other) that has a semicircular recess through which an actuating rod is extendable. It is believed that neither half section would remain on the rod if one were removed, and two screws would have to be unthreaded. In order to facilitate maintaining table games having a kicker member wherein usually the lower part thereof breaks, this invention has been made.

SUMMARY OF THE INVENTION

A kicker member mountable on an actuating rod of a table game having a head portion mountable on an actuating rod, and a kicker portion removably mounted on the head portion to depend therefrom.

One of the objects of this invention is to provide a new and novel kicker member for a table game to facilitate the maintenance thereof. A further object of this invention is to provide a new and novel kicker member for a table game that has a lower kicker portion that may be replaced without removing the head portion from the actuating rod of the game.

BRIEF DESCRIPTION OF THE DRAWINGS

Referring now to FIG. 1, there is shown a fragmentary plan view of a table game, for example table soccer or football, generally designated 10, that includes a table surface 11, vertically extending end and side walls 12 and 13 respectively, and actuating rods 14 that are rotatably and slidably mounted by the side walls in a conventional manner. Resilient bumpers 15 may be mounted on the rods to limit the slidable movement thereof relative the side walls. A handle 20 is mounted on end of each rod and a cap or handle 21 is mounted on the other end, at least one of the handle and cap being removably mounted on the rod. Since the game table, other than the kicker members, may be of the same construction as the game table of U.S. Pat. No. 3,926,432 it will not be further described.

Figure 1:
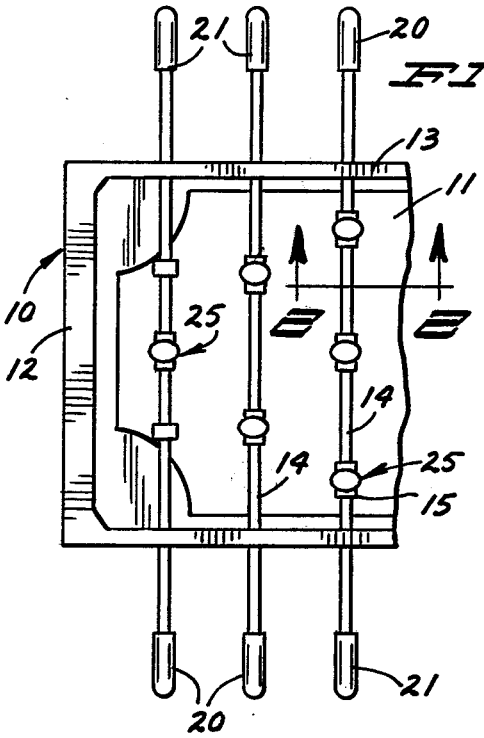
FIG. 1 is a fragmentary plan view of a table game having the kicker members of this invention.
Figure 2:
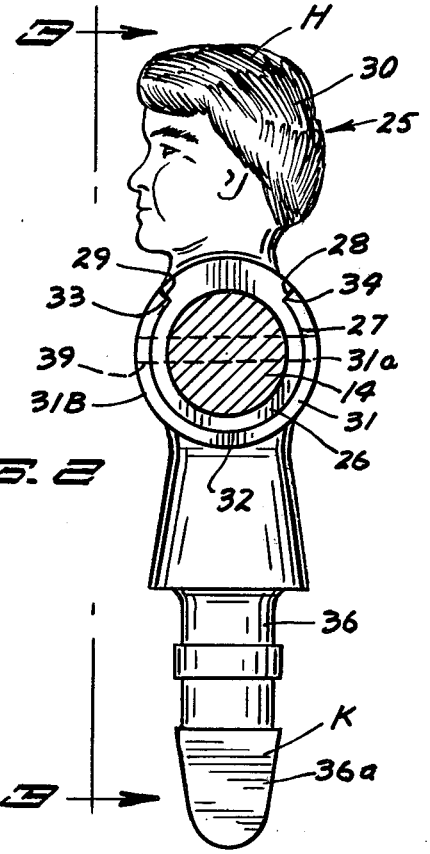
FIG. 2 is an enlarged vertically side view generally taken along the line and in the direction of the arrows 2—2 of FIG. 1 showing a kicker member of the first embodiment of the invention mounted on an actuating rod.
Figure 3:
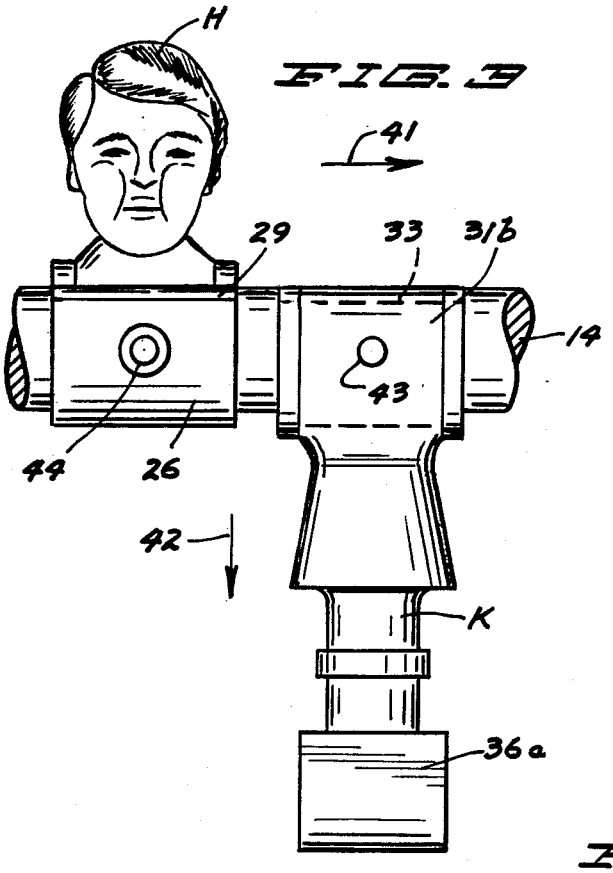
FIG. 3 is a front view generally taken along the line and in the direction of the arrows 3—3 of FIG. 2, other than the lower kicker element is horizontally offset from the head element.

Mounted by the rods are a plurality of kicker members of this invention, generally designated 25 (see FIGS. 2 and 3). Each kicker member includes a head element H and a lower kicker element K. The head element includes a lower ring portion 26 that is of an inner diameter to have a rod 14 extended therethrough whereby the ring portion has leg portions on diametrically opposite sides of the rod, and a circular arcuate outer circumferential surface 27 that extends through an angle of greater than 180°. One arcuate end of surface 27 terminates at a shoulder 28 and the other end at a shoulder 29, the shoulders being part of the top portion 30 of head element H. Portion 30 may be in the shape of the head and shoulders of a human being and is integrally joined to the ring portion to extend thereabove. Shoulders 28, 29, as they extend away from their junctures with surface 27, are progressively more remote from the center of ring portion 26.

The kicker element includes an upper portion 31 that has a circular inner arcuate surface 32 of a diameter to form a relatively close fit with surface 27 and spaced terminal ends 33, 34 that form a close fit with surfaces 28, 29 to abut thereagainst, the surfaces of the terminal ends intersecting the ends of the inner arcuate surface 32 of the upper portion. The minimum spacing of the terminal ends is greater than the diameter of rod 14, but less than the diameter of surface 27. Thus portion 31 provides upwardly extending legs 31*a*, 31*b* that extend on diametrically opposite sides of the rod. The kicker element includes a lower portion 36 that is integrally joined to portion 31 in depending relationship thereto and includes a foot 36*a* of a conventional size and shape for propelling a ball of the game. The center of gravity and balance of kicker member 25 may be the same as that of conventional kicker members.

A screw or bolt 39 is extended through aligned apertures in legs 31*a*, 31*b* of portion 31, diametrically opposite sides of ring portion 26, and rod 14 for removably retaining the assembled elements H, K on the rod with the legs 31*a*, 31*b* abutting against the ring portion and the head element shoulders abutting against the kicker element terminal ends 33, 34 to prevent one turning relative to the other.

By removing the bolt 39 and first moving the kicker element axially (for example direction of arrow 41) along the rod relative the head element so that one is axially separated from the other, and then moving the kicker element radially away from the rod, for example direction of arrow 42, the kicker element can be removed for being replaced by another without having to move the rod 14 or removing the head portion from the rod. Now a new kicker element K can be moved to have the rod located between the legs thereof and then moved axially relative the rod so that the bolt apertures 43 thereof are aligned with the bolt apertures 44 of the ring portion 26 and the rod bolt aperture, and a bolt used to retain the elements in a fixed assembled condition relative to and on the rod. The shoulders and terminal ends 33, 34 are shaped to abut against one another along substantial axial lengths thereof as are the ring portion and upper portion 31. As a result the kicker portion of this invention may be replaced in about a minute in contrast to about 15 minutes for a conventional kicker member wherein the whole rod has to be removed from at least one side wall of the table.

Figure 4:
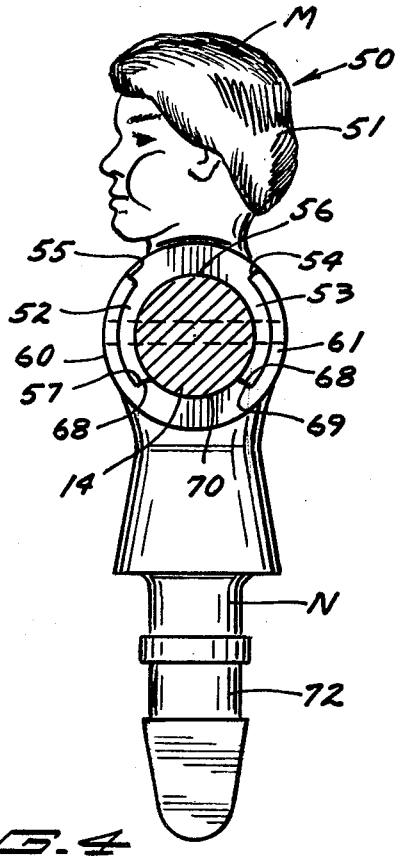
FIG. 4 is a view similar to that of FIG. 2 other than it is of the second embodiment of the invention.

Referring to FIG. 4, the second embodiment of the invention, generally designated 50 includes a head element M that is of the same construction as head element H other than the lower arcuate part of the ring portion is not provided. That is the head element M includes a head portion 51 and a circular partial ring portion integrally joined thereto to depend therefrom. The circular partial ring portion includes a pair of depending legs 52, 53 having arcuately curved, radially outer surfaces that have a radius of curvature that is substantially the same as the outer radius of curvature of ring portion 26, the upper ends of these radially outer surfaces intersecting the lower ends of the surfaces of shoulders 54, 55, which are the same as shoulders 28, 29. The circular partial ring portion has an inner surface 56 that is of a radius of curvature to form a relatively close fit with the actuating rod 14 and which extends through an arcuate angle substantially greater than 180°. Thus the minimum spacing of the terminal lower edges 57, 58 of legs 52, 53 is less than the diameter of rod 14, these edges extending between the inner and outer arcuate surfaces of the legs.

The kicker element N of Member 50 includes an upper portion having a pair of arcuately curved legs 60, 61 that have inner surfaces that are of a radius of curvature to form a close fit with the outer surfaces of legs 52, 53 respectively and upper terminal edges to form a relatively close fit with shoulders 55, 54 respectively. The minimum spacing of the upper terminal edges of legs 60, 61 is less than twice the outer radius of curvature of legs 52, 53 but greater than the diameter of rod 14. The lower ends of the inner surfaces of legs 60, 61 intersect with shoulders 68, 69 respectively which are shaped to form a relatively close fit with terminal edges 57, 58 respectively. The shoulders 68, 69 extend to intersect an arcuately curved surface 70 which extends therebetween and is of a radius of curvature to form a relatively close fit with rod 14. The arcuate lengths of legs 60, 61 advantageously are the same, and the arcuate lengths of legs 52, 53 advantageously are the same.

The lower part 72 of the kicker element N advantageously is the same as the lower part 36 of kicker element K. A screw or bolt 39 is provided for retaining the head element M and kicker element N in an assembled condition on rod 14. The kicker element N may be removed from the head element M and replaced in the same manner as described with reference to the first embodiment.

In each of the embodiments, the vertical height of the legs of the kicker element, and the leg portions 52, 53 is greater than the radius of rod 14.

Further ring portion 26 of the first embodiment is of an inner diameter to form a relatively close fit with rod 14 while the radius of curvature of surfaces 56, 70 are such that when the second embodiment 50 is in an assembled condition on the rod, surfaces 56, 70 form a relatively close fit with the rod.

What is claimed is:

1. For being mounted on an actuating rod of a table game, a kicker member comprising a head element, a kicker element removably mounted on the head element and means for removably securing the head element to the kicker element, the head element including a lower portion having an inner arcuate surface extending through an arcuate angle of more than 180° and of a radius of curvature to form a relatively close fit with the actuating rod and opposite outer, generally arcuate surface portions, and the kicker element having an upper portion that has a pair of spaced legs, the legs having inner arcuate surface portions that form a relatively close fit with the head element outer arcuate surface portions.

2. The apparatus of claim 1 further characterized in that each of the legs has an upper terminal edge, the minimum spacing of the legs upper terminal edges being greater than the diameter of the rod.

3. The apparatus of claim 2 further characterized in that the legs have vertical dimensions that are greater than the radius of the rod.

4. The apparatus of claim 1 further characterized in that the head element has a pair of spaced shoulders, each leg having an upper surface portion abuttable against one of the shoulders.

5. The apparatus of claim 4 further characterized in that the head element lower portion inner surface extends through an arcuate angle of 360°.

6. The apparatus of claim 4 further characterized in that the head element lower portion includes a pair of spaced legs, the last mentioned legs having adjacent surfaces that define at least part of the lower portion inner arcuate surface.

7. The apparatus of claim 6 further characterized in that the head element legs have lower terminal ends that are of a minimum spacing that is less than the diametric dimension of the rod.

8. The apparatus of claim 7 further characterized in that the kicker element has spaced shoulders abuttable against the head element legs terminal ends, that the head element legs extend downwardly from the head element shoulders a distance that is greater than the radius of the rod and that the kicker element has an arcuate surface extending between the kicker element shoulders and is of a radius of curvature that is substantially equal to the radius of the rod.

9. For being mounted on a horizontally elongated actuating rod of a table game, a kicker member comprising a head element, a kicker element removably mounted on the head element and means for removably securing the head element to the kicker element, the head element including a lower portion having spaced leg portions that have adjacent surfaces and remote outer surfaces opposite their adjacent surfaces, and a downwardly facing surface of a shape to substantially form a mating fit with the upper part of the rod and defining at least part of the adjacent surfaces of the above leg portions, and the kicker element having a lower portion and spaced legs joined thereto to extend thereabove, the kicker element legs having adjacent surfaces of a shape to form a substantially mating fit with at least parts of the head element legs outer surfaces.

10. The apparatus of claim 9 further characterized in that the head element legs has lower terminal ends and that the kicker element has upper terminal ends that are at a higher elevation than the head element legs lower ends.

11. The apparatus of claim 10 further characterized in that the legs and leg portions have aligned screw apertures and that the securing means comprises a screw.

12. The apparatus of claim 9 further characterized in that the kicker element legs having terminal upper edge portions that are of a minimum spacing from one another by a dimension that is substantially greater than the corresponding maximum transverse dimension of the rod.

13. The apparatus of claim 12 further characterized in that the head element lower portion includes a lower part integrally joined to the head element leg portions to abut against the lower part of the rod, the lower part having a surface that in conjunction with said downwardly facing surface completely surrounds the rod.

14. The apparatus of claim 12 further characterized in that the leg portions have lower terminal ends that are substantially spaced from one another, and that the kicker element has a surface for abutting against the rod between the leg portions terminal ends, that the legs inner surfaces and leg portion outer surfaces are arcuately curved and are in abutting relationship with the legs inner surfaces along substantially the entire arcuate length thereof.

15. The apparatus of claim 12 wherein the rod is of a circular cylindrical shaped, further characterized in that the leg portions extend on diametrically opposite sides of the rod and the legs extend on diametrically opposite sides of the rod and abut against the leg portions outer surfaces radially on the opposite sides thereof from the rod.

* * * * *